US005765640A

United States Patent [19]

Milne et al.

[11] Patent Number: 5,765,640

[45] Date of Patent: Jun. 16, 1998

[54] MULTIPURPOSE TOOL

[75] Inventors: John R. Milne, Aberdeen, Scotland; Jeff E. Toulouse, Houston, Tex.; Gary J. Pape, Dubai, United Arab Emirates; George M. Lorgen, Peterhead, Scotland; Malcolm D. Pitman, Aberdeen, Scotland; Robin J. Rafferty, Peterculter, Scotland

[73] Assignee: Baker Hughes Incorporated, Houston, Tex.

[21] Appl. No.: 612,034

[22] Filed: Mar. 7, 1996

[51] Int. Cl.[6] ..... E21B 23/01; E21B 23/04

[52] U.S. Cl. ..... 166/206; 166/212

[58] Field of Search ..... 166/206, 212, 166/214, 381, 382, 383, 237

[56] References Cited

U.S. PATENT DOCUMENTS

| | | | |
|---|---|---|---|
| 3,664,416 | 5/1972 | Nicolas et al. | 166/212 X |
| 4,116,274 | 9/1978 | Rankin et al. | 166/206 X |
| 4,184,546 | 1/1980 | Nicolas et al. | 166/206 |
| 4,819,760 | 4/1989 | Petermann | 166/212 X |
| 4,960,173 | 10/1990 | Cognevich et al. | 166/214 X |
| 5,413,173 | 5/1995 | Mills et al. | 166/212 |

FOREIGN PATENT DOCUMENTS

| | | |
|---|---|---|
| 1601260 | 10/1981 | United Kingdom . |
| 2155519 | 9/1985 | United Kingdom . |
| 2173533 | 10/1986 | United Kingdom . |
| 2272233 | 5/1994 | United Kingdom . |
| 2297106 | 7/1996 | United Kingdom . |
| 96/34176 | 10/1996 | WIPO . |

*Primary Examiner*—David J. Bagnell

*Attorney, Agent, or Firm*—Rosenblatt & Redano, P.C.

[57] ABSTRACT

A multipurpose tool is disclosed which has as one of its purposes anchoring coiled tubing during certain downhole operations such as milling. In the anchor format the tool is run in in the retracted position and then expanded to get a grip on the casing or tubing in the wellbore prior to actuation of a downhole tool such as a mill, which is generally driven by a downhole motor. A flushing mechanism keeps the anchoring assembly free of debris so that it functions properly. The anchoring assembly employs a linkage of two or more links depending on the size of the tubing against which the coil tubing is to be anchored and the amount of anchoring force required. The same tool through a switchout of linkage components can serve a multitude of other functions on separate runs in the well or on the same run with one tool body. The tool can serve as a sleeve shifting tool, a centralizer, or a tubing end locator. The tool can expand to a ratio of greater than 1.2:1 to about 2 to 3:1 and then retract to its original run-in diameter.

26 Claims, 6 Drawing Sheets

MULTIPURPOSE TOOL

FIELD OF THE INVENTION

The field of this invention relates to multipurpose tools which can accomplish anchoring, locating or/and shifting, particularly those used in conjunction with coiled tubing.

BACKGROUND OF THE INVENTION

In the past, while using coiled tubing in conjunction with downhole motors, certain downhole operations had to be performed such as milling, involving underreamers or other milling tools that have pivotally mounted arms. Stability of the cutting tool during the operation is of great importance since only the area targeted for milling should be milled. However, in the past, stabilization of the coiled tubing string has been a problem. Various attempts have been made to stabilize the tubing string during certain downhole operations with coiled tubing focusing casing collars primarily on the use of hydraulically actuated centralizers. While there are some friction forces involved in using the centralizers which provided some small degree of support, the anticipated loads on the coiled tubing during such downhole operations as milling easily overcame the grip of a centralizer. As a result, prior operations left some doubt as to the position of the tool such as a mill during the operation.

It is thus one of the many objectives of the present invention to provide a simple yet functional anchoring device for coiled tubing which is easy to operate and reliable. Another objective of the present invention is to provide a system where after setting the anchoring assembly the weight set down on the coiled tubing holds the anchor in place. It is another object of the present invention to use a flushing system to keep debris in the circulating mud within the wellbore from fouling the anchoring assembly. It is another object of the invention to provide different configurations of the anchoring assembly to accommodate different size pipe or tubing in which the coiled tubing must be anchored. Yet another object is to provide for an emergency release in the event the anchoring mechanism fails to let go when needed. Another object is to provide a slim tool that can expand by a factor of at least 1.2:1 and in some cases by a factor of 2 or 3:1.

Yet another object of the present invention is to use the basic layout of the tool to perform a wide variety of functions such as shifting of sleeves downhole, locating nipple profiles or tubing ends. One or more functions can be accomplished using the same basic tool body. Another object is to allow one or more functions from the same body in different trips into the well or multiple functions on one body to accomplish a variety of tasks in one trip. These and other objectives will be more clearly understood by a review of the description of the preferred embodiment.

SUMMARY OF THE INVENTION

A multipurpose tool is disclosed which has as one of its purposes anchoring coiled tubing during certain downhole operations such as milling. In the anchor format the tool is run in in the retracted position and then expanded to get a grip on the casing or tubing in the wellbore prior to actuation of a downhole tool such as a mill, which is generally driven by a downhole motor. A flushing mechanism keeps the anchoring assembly free of debris so that it functions properly. The anchoring assembly employs a linkage of two or more links depending on the size of the tubing against which the coil tubing is to be anchored and the amount of anchoring force required. The same tool through a switchout of linkage components can serve a multitude of other functions on separate runs in the well or on the same run with one tool body. The tool can serve as a sleeve shifting tool, a centralizer, or a tubing end locator. The tool can expand to a ratio of greater than 1.2:1 to about 2 to 3:1 and then retract to its original run-in diameter.

DETAILED DESCRIPTION OF THE PREFERRED EMBODIMENT

Figure 1:
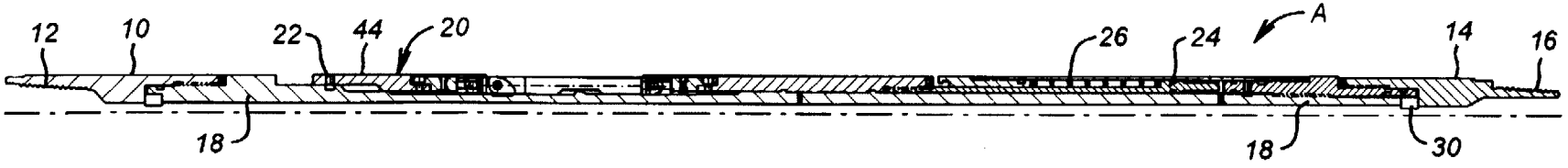
FIG. 1 is a sectional view of the entire tool shown with a two-link linkage.

The overall assembly of the apparatus A is illustrated in FIG. 1. A top sub 10 has a thread 12 to which a tubing string such as coiled tubing (not shown) can be attached. At the other end of the tool is the bottom sub 14. The bottom hole assembly (not shown) is connected at thread 16 of bottom sub 14. Typically, when using coiled tubing the bottom hole assembly will include a downhole motor. In applications using the apparatus A, the bottom hole assembly could include a variety of downhole tools such as a milling tool or a fishing tool. Attached to the top sub 10 is an inner mandrel 18. An outer assembly 20 is secured to the bottom sub 14. To effect an emergency release, the shear pin or pins 22 can be broken to allow separation between the inner mandrel 18 and the outer assembly 20. The outer assembly moves up relative to inner mandrel 18 to allow for example links 36 and 40 to retract.

Figure 7:
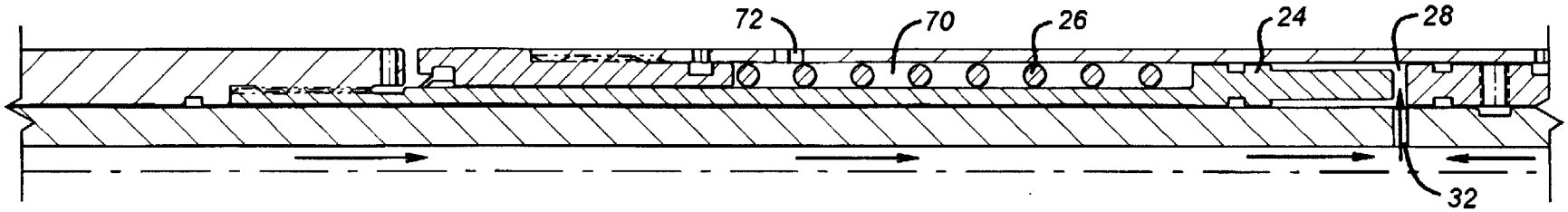
FIG. 7 is a detailed view of the piston spring arrangement for actuating the linkage.

Part of the outer assembly is a piston 24 biased by a spring 26 as seen more clearly in FIG. 7. A cavity 28 becomes pressurized due to back pressure created when fluid is pumped down through the top sub 12. A restrictor 30 shown in FIG. 1 creates back pressure at port 32 which in turn builds up the pressure on piston 24 so that the force exerted in the opposite direction by spring 26 is ultimately overcome and the net result is upward piston movement. The piston 24 may be made in several components which ultimately end in a pivot 34 (see FIG. 2). In the embodiment shown in FIGS. 2 and 3 link 36 is connected to the piston 24 at pivot 34. Pivot 38 connects link 36 to link 40. Pivot 42 connects the link 40 to sleeve 44. Link 36 has a cutout 46 which allows it to translate and rotate without encountering ramp 48. Ramp 48 serves a function in the embodiment illustrated in FIGS. 4 and 5 as will be explained below. Link 40 has a serrated surface 50 at its cantilevered end and it is configured as shown in FIG. 3 so that the serrated surface at the time it contacts the casing or tubing or shifting sleeve, is relatively in alignment with the wall into which the serrated teeth 50 will take a bite. It should be noted that the pivot 38 is located radially outwardly further than the pivot 34 such that when the piston 24 moves upwardly pivot 38 is pushed outwardly immediately and the motion shown by comparing FIG. 2 to FIG. 3 is obtained without putting the linkage in a bind.

Figure 5:
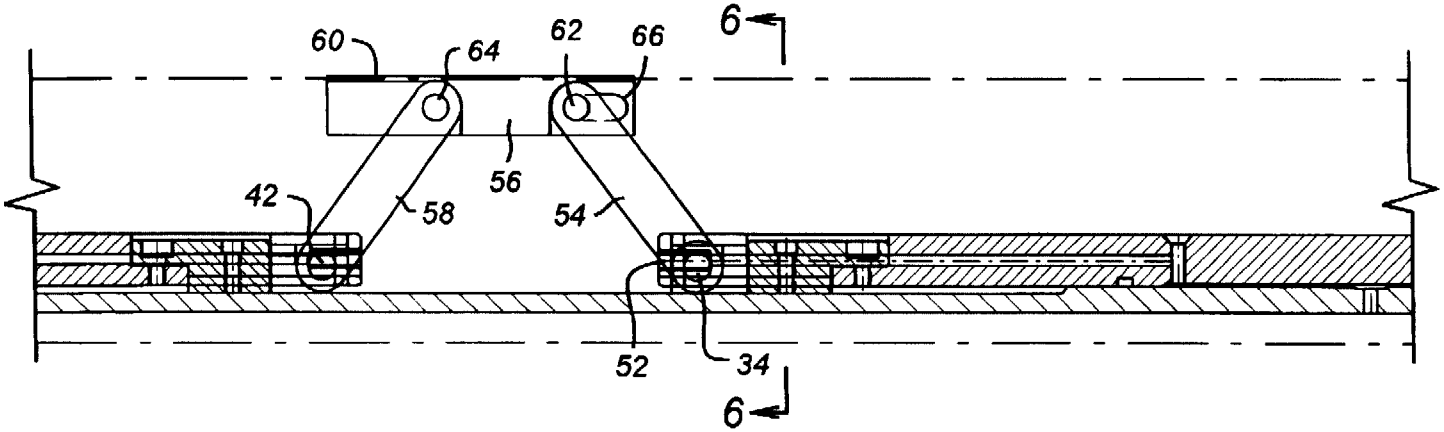
FIG. 5 is the view of FIG. 4 in the anchored or set position.
Figure 8:
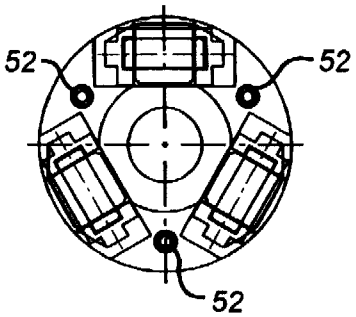
FIG. 8 is a section view looking along lines 8—8 of FIG. 2.

As previously mentioned, when flow is put in and a backpressure is created due to the presence of restrictor 30, port 51 in the inner mandrel 18 communicates with passages 52 which terminate adjacent the pivot 34. FIG. 8 shows an end view illustrating the termination of passages 52. These passages allow fluid to be moved continuously uphole adjacent each of the links 36. Those skilled in the art will appreciate by looking at FIGS. 2 and 3 in conjunction with 8 that in the preferred embodiment there are three identical assemblies displaced from each other at 120°. It is within the purview of the invention to use one or more of the assemblies as illustrated in FIGS. 2 or 5. Additionally, each linkage need not be identical in a given transverse plane to the axis of the apparatus A. More than one elevation of linkages can be used on a given body which are separately actuated or actuated at the same time using one piston 24 or a plurality of such pistons 24. The uphole orientation of the passages 52 flush away any debris from the area of links 36 and 40 to promote the smooth functioning of the linkage downhole. In the preferred embodiment, the two-link system shown in FIGS. 2 and 3 is used generally for tubular casing sizes of four inches and smaller. It is desirable to limit the angle that link 40 makes with the longitudinal axis to about 60°. Greater angles will reduce the contact pressure exerted by link 40 through the cantilevered serrated surface 50 onto the casing or tubing T.

Figure 2:
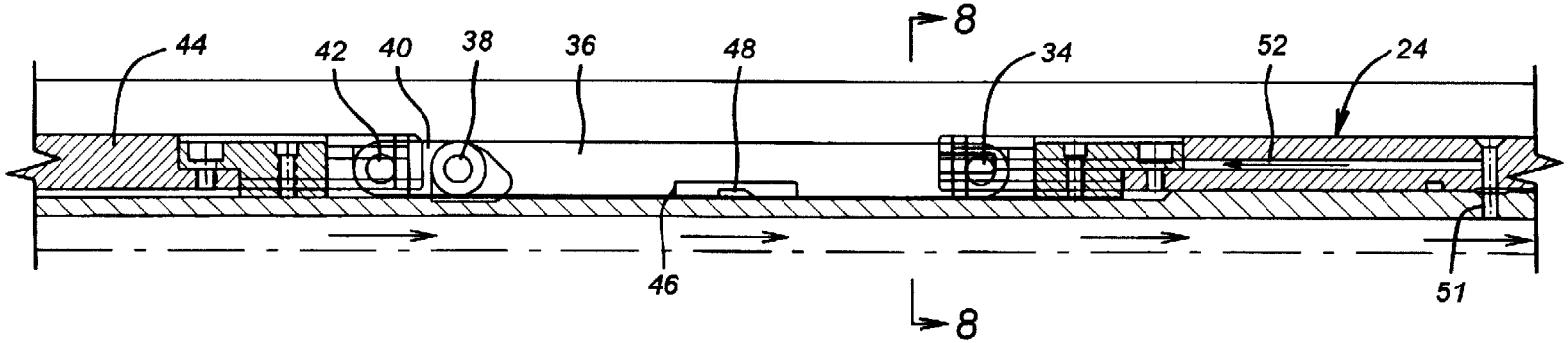
FIG. 2 is a detailed view of the linkage shown in FIG. 1 in the run in position.
Figure 3:
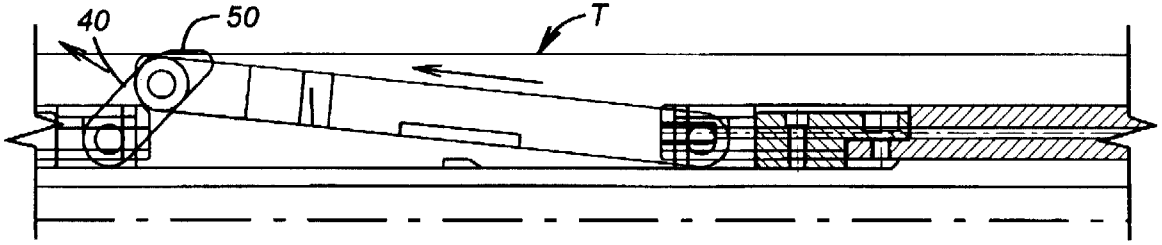
FIG. 3 is a view of FIG. 2 in the anchored position.
Figure 4:
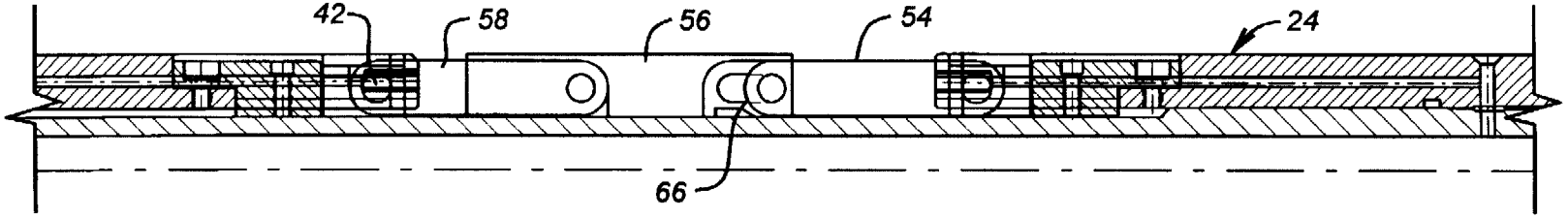
FIG. 4 is a view of an alternative three-link linkage in the retracted position.
Figure 6:
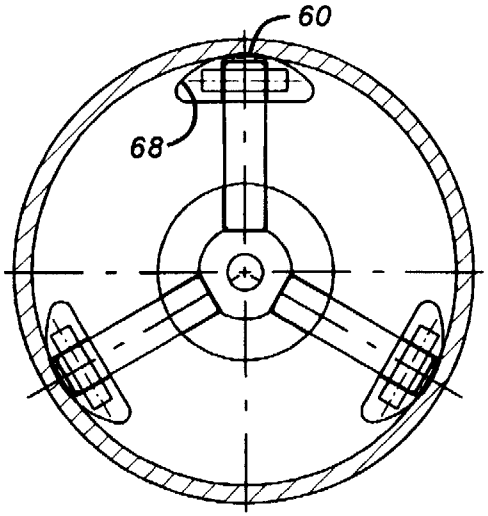
FIG. 6 is the view looking along line 6—6 of FIG. 5.

The embodiment shown in FIGS. 4 through 6 operates in a similar manner to the embodiment shown in FIGS. 2 and 3. The linkage is different. The pivots 34 and 42 are identical. Pivot 34 is the lowermost mounting point for a variety of linkages. It translates responsive to piston movement. Pivot 42 is a fixed portion of the outer body 20 and is rotationally locked thereto. However, the linkage in FIGS. 4 through 6 comprises three links 54, 56 and 58. Link 56 has a curved serrated surface 60. Link 54 is connected to link 56 by pin 62 and link 56 is connected to link 58 by pin 64.

As seen in FIG. 4 link 56 has an elongated slot 66 such that when the piston assembly 24 is urged uphole, link 54 travels uphole sufficiently to be deflected by ramp or cam 66. Since pivot 42 is stationary, link 58 begins counterclockwise rotation as link 54 begins clockwise rotation upon further movement of piston 24 after encountering ramp 66. As a result link 56 moves outwardly substantially parallel to the longitudinal axis of the tool. The embodiment in FIGS. 4 through 6 also uses the blow ports 52 whose layout is better shown in FIG. 8. While FIG. 8 is a cross-section with regard to the embodiment shown in FIGS. 2 and 3, the location of the blow ports 52 in the embodiment of FIGS. 4 through 6 is similar. FIG. 6 illustrates the cross-sectional profile of link 56 illustrating the use of a rounded leading edge 68 on which is found the serrated surface 60. Again the preferred layout is a 120° spacing. Again the linkage totals can vary and each linkage need not be identical in size or function or in the same transverse plane.

In the event the embodiment in FIGS. 3 or 5 fails to release an upward pull on the top sub 12 breaks shear pin or pins 22 as shown in FIG. 1 and allows the tubing or tubing string to be removed from the wellbore with the bottom hole linkage to retract.

It should be noted that the sleeve 44 which supports the pivot 42 is rotationally locked to the inner mandrel 18 such that force transmitted through the bottom hole assembly to the apparatus A when in the gripping mode as illustrated in FIGS. 3 or 5 goes from the inner mandrel 18 to the outer assembly 20 and ultimately to link 40 or link 56 depending on the application. In this way, the apparatus A of the present invention is able to resist the torque of downhole tools such as milling tools while at the same time lending support to the coiled tubing string during such operations.

The apparatus A has a slim profile and can expand by a ratio of 1.2:1 to about 2 or 3:1 or more and then retract to its original run-in diameter. For example, a 2⅛" tool can pass through a 2½" restriction and expand to anchor in a 5" opening.

Those skilled in the art will appreciate that once the apparatus A has been actuated to the position shown in FIG. 3 or FIG. 5, weight can be set down and the grip is retained without circulation. The release feature for normal operations is accomplished by picking up on the tubing string without circulation therethrough. When this happens the spring 26 overcomes the piston 24. Spring 26 is housed in a cavity 70 which is open to the annulus through port 72. Thus, without circulation, the net of the hydrostatic forces on piston 24 cannot overcome the force of spring 26 and the piston 24 is displaced downhole. In the position shown in FIG. 7 the spring 26 is in the relaxed position as the piston 24 is fully retracted for run in as shown in either FIGS. 1, 2 or 4.

Figure 9:
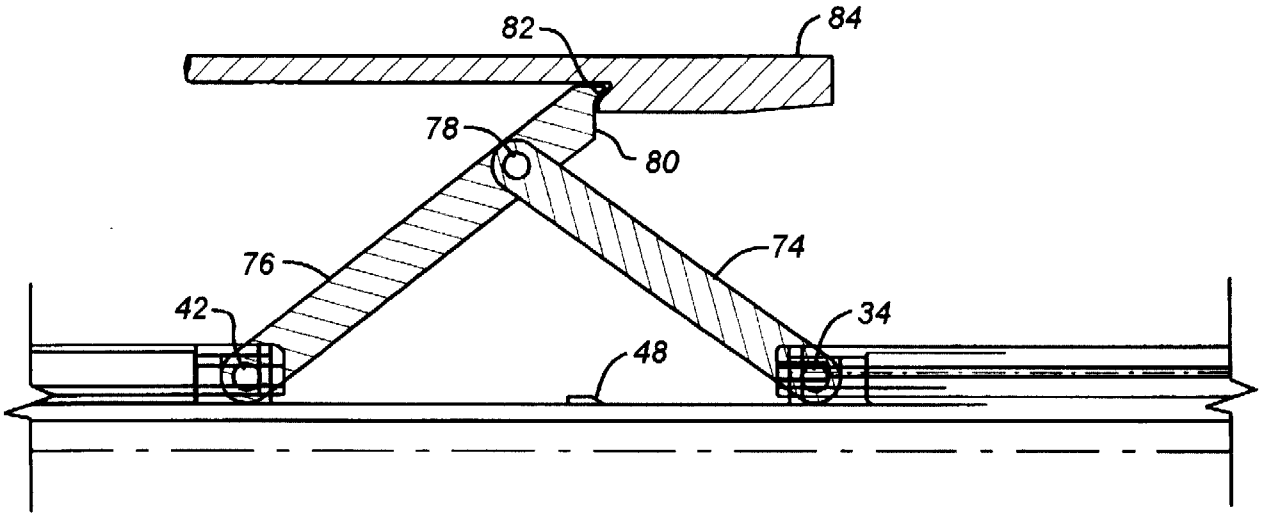
FIG. 9 is an alternative embodiment illustrating the use of the apparatus as a sleeve shifting tool.

The versatility of the apparatus A is illustrated by also referring to FIGS. 9 through 12. Again the same underlying apparatus A is illustrated uphole of pivot 42 and downhole of pivot 34. In FIGS. 9 through 12 the extended position shown after the lowermost link 74 has been urged to begin its movement clockwise after encountering the ramp 48. In FIG. 9, link 74 is pinned to link 76 at pivot 78. Link 76 has a generally pointed cantilevered end 80 so that it may catch the groove 82 in a sliding sleeve 84 so that the sliding sleeve can be moved downhole in the embodiment shown in FIG. 9. Those skilled in the art will appreciate that the linkage or the entire tool itself shown in FIG. 9 can be reversed and/or added in a reversed orientation onto the apparatus A to allow links such as 76 to catch a different groove oriented opposite the groove 82 so that the sliding sleeve 84 can also be pulled uphole within the pulling limits of the tubing string. Depending on the orientation of the linkage, emergency release can be by jarring uphole or downhole. Optionally, link 76 could have an elongated slot instead of a hole to accept pivot 78 similar to the connection illustrated in FIG. 4.

Figure 10:
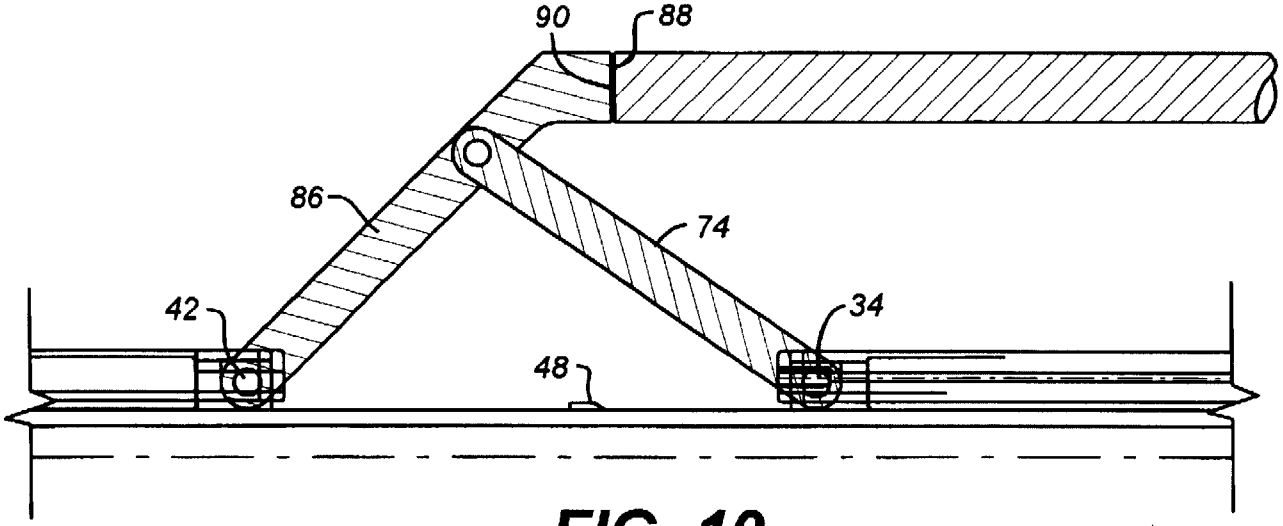
FIG. 10 is an alternative embodiment of the apparatus showing it in a configuration for locating tubing ends.

FIG. 10 illustrates link 74 connected to a link 86 which has a downwardly oriented surface 88 on its cantilevered end so that when extended it can be caught on the top 90 of a tubing. In this manner the top of the tubing in the wellbore can be ascertained with the apparatus A. A recess in the inner mandrel 18 can be provided to accept surface 88 so that link 86 can be fully retracted.

Figure 11:
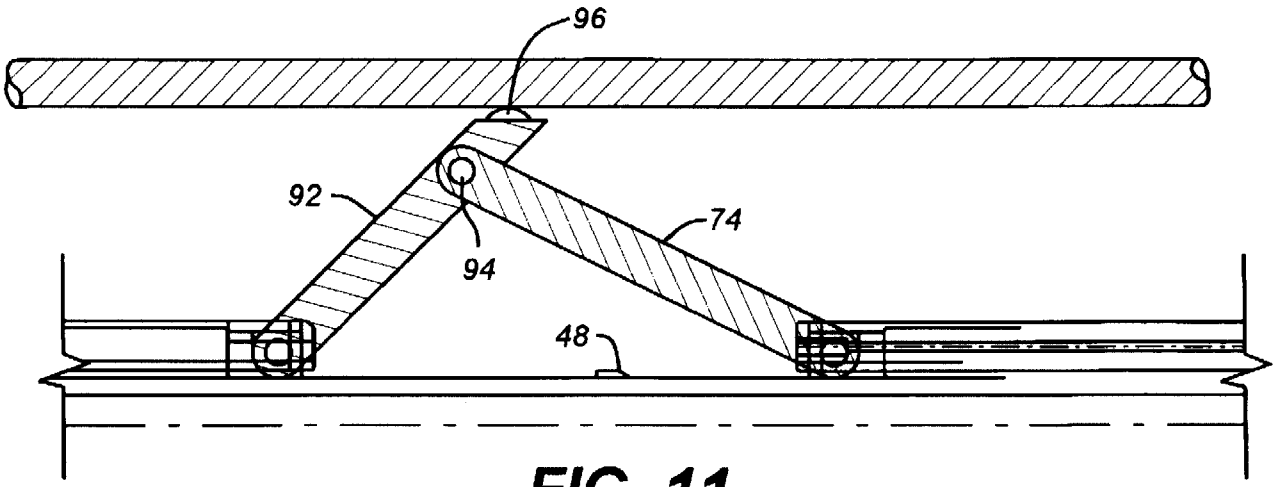
FIG. 11 is an alternative embodiment of the apparatus showing how it may be used as a centralizer or combined with another alternative embodiment, such as that shown in FIG. 9, to combine the functions of a centralizer and a sleeve-shifting tool, for example.

FIG. 11 is yet another alternate embodiment illustrating the link 74 connected to link 92 at pivot 94. Link 92 has a ballbearing 96 or an equivalent low friction end so that it can serve as the centralizer for the tubing string. In all other respects the operation is the same as the previous embodiment.

Figure 12:
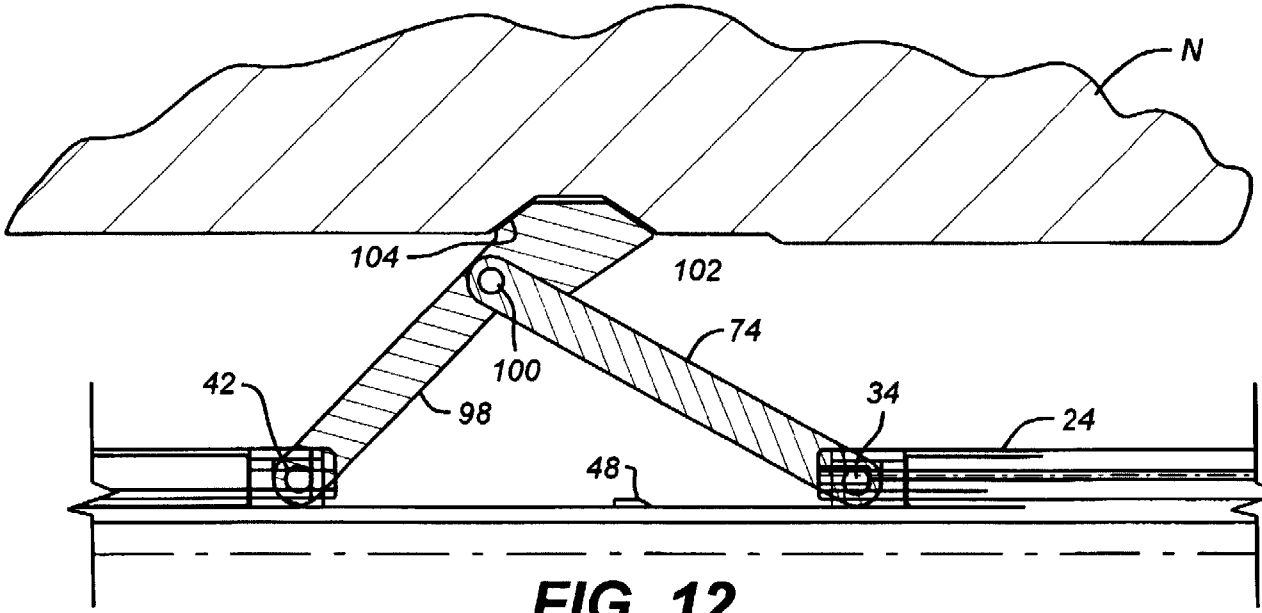
FIG. 12 is an alternative embodiment of the apparatus showing how it can be used as a nipple profile locator and FIG. 13 is a sectional elevational view of the tool, showing tandem use of a sleeve shifter and centralizer linkages at the same time on the tool.
Figure 13:
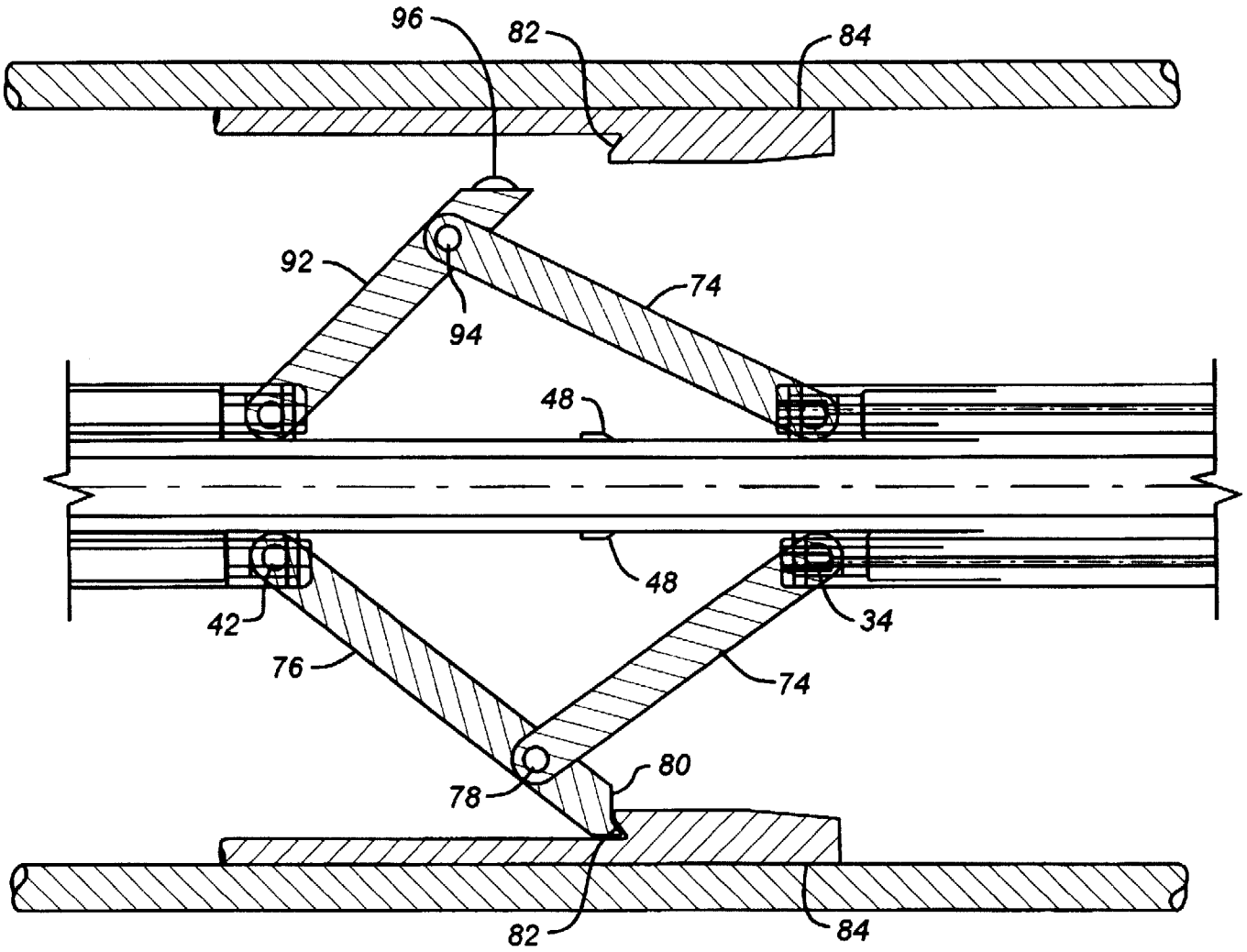

In FIG. 12, link 74 is connected to link 98 at pivot 100. In this embodiment link 98 has a unique shape on its cantilevered end 102 which conforms to the recess 104. With the linkage in the extended position due to the operation of the piston assembly 24, the nipple profile is located when weight can be set down from the surface indicating that the end 102 has found itself in the nipple profile 104. After setting down, one would pickup to ensure end 102 has fully engaged profile 104. Those skilled in the art will appreciate that the embodiments illustrated in FIGS. 9 through 12 represent but one linkage and the preferred embodiment incorporates three identical linkages operated by the same piston assembly 24 spaced circumferentially at 120°. However, other configurations using a different number of identical linkages or linkages for different purposes together such as a centralizer in combination with a sleeve shifter(see FIG. 13) are all within the spirit of the invention. As shown in FIG. 13, the invention also comprises a single piston moving a plurality of different linkages to accomplish two or more tasks using one tool body in a single trip in the well. The same result can be obtained with a plurality of pistons actuated at the same or different times or even a single piston that actuates linkages in more than one transverse plane, or elevation, along the tool body.

The versatility of the apparatus A is now apparent. The same tool body can accommodate a variety of linkages separately or at the same time. The drawings in this application are illustrative of some of those applications although yet others can be envisioned. With a rapid changeout at the surface, the same tool can function to serve a multiplicity of purposes. The design and construction is simple. An emergency release through the use of a shear pin or pins 22 or equivalent is provided as well as a continuous cleanout feature using the passages 52 as long as fluid is being circulated. Whichever form of linkage(s) used, the jet of fluid passing through the passages 52 flushes away dirt and debris and keeps it from accumulating adjacent the linkage (s) area where it could adversely affect its operation.

The foregoing disclosure and description of the invention are illustrative and explanatory thereof, and various changes in the size, shape and materials, as well as in the details of the illustrated construction, may be made without departing from the spirit of the invention.

We claim:

1. A downhole multipurpose tool comprising:

a body having at least one mounting member;

at least one actuating assembly mounted to said body and having a movable component thereon;

a plurality different of linkages mountable between said mounting member and said movable component to allow the same tool body and actuating assembly to selectively function in a variety of applications.

2. The downhole multipurpose tool of claim 1 wherein different said linkages to accomplish different tasks can be used between said moving member and said actuating assembly in successive trips to a wellbore.

3. The downhole multipurpose tool of claim 2 wherein:

each said linkage has at least two links; and said actuating assembly urges at least one end of one of said links to move outwardly.

4. The downhole multipurpose tool of claim 3 wherein:

at least one of said linkages has links which are pinned together with pinned connections, said connections disposed during run in at different distances radially from the longitudinal axis of said body to promote outward movement of at least one of the links in reaction to linear movement of said actuating assembly.

5. The downhole multipurpose tool of claim 3 wherein:

said linkages comprise two links, a first link pivotally connected to said actuating assembly at at one end and pivotally connected to a second link at an intermediate portion thereof leaving a cantilevered end of said second link to perform at least one given downhole function upon extension away from said body.

6. The downhole multipurpose tool of claim 5 wherein:

said cantilevered end has outwardly oriented serrations to grab a casing or tubing or shifting sleeve.

7. The downhole multipurpose tool of claim 5 wherein:

said cantilevered end has a low friction element to allow said linkages to serve as a centralized for said body.

8. The downhole multipurpose tool of claim 5 wherein:

said cantilevered end has a profile that matches a nipple profile downhole so that a nipple profile can be located from the surface due to expansion of said cantilevered end into the nipple profile.

9. The downhole multipurpose tool of claim 2 wherein:

at least one of said linkages has at least three links connecting said mounting member to said movable component such that an intermediate link of said links moves outwardly substantially parallel to the axis of said body until contact with tubing or casing in a well bore.

10. The downhole multipurpose tool of claim 9 wherein:

at least one of said links is connected to an adjacent link with a lost motion feature to allow for limited relative movement between said links;

whereupon as a result of said relative movement a camming action off said body occurs which ultimately moves said intermediate link outwardly.

11. The downhole multipurpose tool of claim 10 wherein:

said intermediate link has a rounded outer face with serrations;

said actuating assembly comprises a fluid actuated biased piston.

12. The downhole multipurpose tool of claim 1 wherein:

said linkages are movable between a retracted and an expanded position such that upon expansion the outer reach of said linkages is at a ratio of greater than about 1:2:1 as compared to the outer reach of said linkages in said retracted position.

13. A downhole multipurpose tool, comprising:

a body having at least one mounting member;

at least one actuating assembly mounted to said body and having a movable component thereon;

a plurality of linkages mountable between said mounting member and said movable component to allow the same tool body and actuating assembly to selectively function in a variety of applications; and different linkages being simultaneously attached between said mounting member and said movable component to accomplish different tasks in a single trip in the wellbore.

14. A downhole multipurpose tool, comprising:

a body having at least one mounting member;

at least one actuating assembly mounted to said body and having a movable component thereon;

a plurality of linkages mountable between said mounting member and said movable component to allow the same tool body and actuating assembly to selectively function in a variety of applications;

wherein different said linkages to accomplish different tasks can be used between said moving member and said actuating assembly in successive trips to a wellbore;

at least one of said linkages has at least three links connecting said mounting member to said movable component such that an intermediate link of said links moves outwardly substantially parallel to the axis of said body until contact with tubing or casing in a well bore;

at least one of said links is connected to an adjacent link with a lost motion feature to allow for limited relative movement between said links;

whereupon as a result of said relative movement a camming action off said body occurs which ultimately moves said intermediate link outwardly;

said intermediate link has a rounded outer face with serrations;

said actuating assembly comprises a fluid actuated biased piston; and said body contains a restriction orifice which upon fluid circulation creates a back pressure which acts on said piston to move it against said bias and toward said mounting member.

15. The downhole multipurpose tool of claim 14 wherein:

said intermediate link retains a grip on tubing or casing with setdown weight on said body even after circulation through said body stops.

16. The downhole multipurpose tool of claim 15 wherein:

said biasing on said piston retracts said intermediate link if circulation through said body stops with no setdown weight on said body.

17. The downhole multipurpose tool of claim 16 further comprising:

a shear release to allow removal of a portion of said body if said intermediate link fails to release when circulation stops without setdown weight on said body.

18. The downhole multipurpose tool of claim 17 wherein:

said body is formed having passages therethrough which facilitate flow through said body to the area of said linkage using said backpressure which also acts on said piston.

19. A downhole multipurpose tool, comprising:

a body having at least one mounting member;

at least one actuating assembly mounted to said body and having a movable component thereon;

a plurality of linkages mountable between said mounting member and said movable component to allow the same tool body and actuating assembly to selectively function in a variety of applications;

said actuating assembly comprises of a biased fluid-driven piston; and said body comprises a restrictor to create backpressure in said body with fluid flow therethrough, said backpressure overcoming said biasing of said piston to actuate said linkages.

20. The downhole multipurpose tool of claim 19, wherein:

said body contains passages therethrough such that said backpressure creates fluid flow directed at at least one of said linkages.

21. A downhole multipurpose tool, comprising:

a body having at least one mounting member;

at least one actuating assembly mounted to said body and having a movable component thereon;

a plurality of linkages mountable between said mounting member and said movable component to allow the same tool body and actuating assembly to selectively function in a variety of applications;

wherein different said linkages to accomplish different tasks can be used between said moving member and said actuating assembly in successive trips to a wellbore;

each said linkage has at least two links;

said actuating assembly urgers at least one end of one of said links to move outwardly;

said linkages comprise two links, a first link pivotally connected to said actuating assembly at one end and pivotally connected to a second link at an intermediate portion thereof, leaving a cantilevered end of said second link to perform at least one given downhole function upon extension away from said body; and said cantilevered end is formed into a shape to engage a groove on a shifting sleeve downhole for shifting thereof.

22. A downhole multipurpose tool, comprising:

a body having at least one mounting member;

at least one actuating assembly mounted to said body and having a movable component thereon;

a plurality of linkages mountable between said mounting member and said movable component to allow the same tool body and actuating assembly to selectively function in a variety of applications;

wherein different said linkages to accomplish different tasks can be used between said moving member and said actuating assembly in successive trips to a wellbore;

each said linkage has at least two links;

said actuating assembly urges at least one end of one of said links to move outwardly;

said linkages comprise two links, a first link pivotally connected to said actuating assembly at one end and pivotally connected to a second link at an intermediate portion thereof, leaving a cantilevered end of said second link to perform at least one given downhole function upon extension away from said body; and said cantilevered end, upon extension, is formed to be in substantial alignment with a longitudinal axis of said body so that when said linkage is actuated it will encounter a tubing end downhole to aid in its location from the surface.

23. A downhole multipurpose tool, comprising:

a body having at least one mounting member;

at least one actuating assembly mounted to said body and having a movable component thereon;

a plurality of linkages mountable between said mounting member and said movable component to allow the same tool body and actuating assembly to selectively function in a variety of applications;

wherein different said linkages to accomplish different tasks can be used between said moving member and said actuating assembly in successive trips to a wellbore;

each said linkage has at least two links;

said actuating assembly urges at least one end of one of said links to move outwardly;

said actuating assembly comprises of a biased fluid-driven piston;

said body comprises a restrictor to create backpressure in said body with fluid flow therethrough, said backpressure overcoming said biasing of said piston to actuate said linkages; and said body contains passages therethrough such that said backpressure creates fluid flow directed at at least one of said linkages.

24. The downhole multipurpose tool of claim 23 further comprising:

a shear release to allow at least a portion of said body to be removed if said linkages fail to retract.

25. A downhole multipurpose tool, comprising:

a body having at least one mounting member;

at least one actuating assembly mounted to said body and having a movable component thereon;

a plurality of linkages mountable between said mounting member and said movable component to allow the same tool body and actuating assembly to selectively function in a variety of applications;

wherein different said linkages to accomplish different tasks can be used between said moving member and said actuating assembly in successive trips to a wellbore;

each said linkage has at least two links; and said actuating assembly urges at least one end of one of said links to move outwardly;

at least one of said linkages has links which are pinned together with pinned connections, said connections disposed during run in at different distances radially from the longitudinal axis of said body to promote outward movement of at least one of the links in reaction to linear movement of said actuating assembly;

said linkages are varied to include at least two different cantilevered ends for accomplishing more than one task downhole with a single body in a single trip.

26. A downhole multipurpose tool, comprising:

a body having at least one mounting member;

at least one actuating assembly mounted to said body and having a movable component thereon;

a plurality of linkages mountable between said mounting member and said movable component to allow the same tool body and actuating assembly to selectively function in a variety of applications;

said actuating assembly comprises of a biased fluid driven piston;

said body comprises a restrictor to create backpressure in said body with fluid flow therethrough, said backpressure overcoming said biasing of said piston to actuate said linkages;

said linkages are movable between a retracted and an expanded position such that upon expansion, the outer reach of said linkages is in a range of a ration of about 1.2:1 to about 3:1 as compared to the outer reach of said linkages in said retracted position.

* * * * *